US005627508A

United States Patent [19]

Cooper et al.

[11] Patent Number: 5,627,508

[45] Date of Patent: May 6, 1997

[54] PILOT VEHICLE WHICH IS USEFUL FOR MONITORING HAZARDOUS CONDITIONS ON RAILROAD TRACKS

[75] Inventors: Guy F. Cooper; Robert F. Anderson, both of Ventura, Calif.

[73] Assignee: The United States of America as represented by the Secretary of the Navy, Washington, D.C.

[21] Appl. No.: 644,464

[22] Filed: May 10, 1996

[51] Int. Cl.[6] ..... B60Q 1/00

[52] U.S. Cl. ..... 340/425.5; 340/539; 340/566; 246/166.1; 246/167 R; 73/636

[58] Field of Search ..... 340/425.5, 539, 340/566; 246/166.1, 121, 167; 180/167; 364/551; 73/636

[56] References Cited

U.S. PATENT DOCUMENTS

| | | | |
|---|---|---|---|
| 3,128,975 | 4/1964 | Dan | 246/121 |
| 4,302,746 | 11/1981 | Scarzello et al. | 340/938 |
| 4,578,665 | 3/1986 | Yang | 340/48 |
| 5,295,551 | 3/1994 | Sukonick | 180/167 |
| 5,429,329 | 7/1995 | Wallace et al. | 246/166 |

*Primary Examiner*—Jeffery Hofsass
*Assistant Examiner*—Davetta Woods
*Attorney, Agent, or Firm*—David S. Kalmbaugh; Melvin J. Sliwka

[57] ABSTRACT

A self-propelled remotely controlled pilot vehicle adapted for use on railroad tracks to monitor hazardous conditions and obstacles on the railroad tracks. The pilot vehicle precedes a train along the railroad tracks at a distance which will allow the train to come to a complete stop in the event the pilot vehicle encounters a hazardous condition on the track. The pilot vehicle is equipped with a sensor array which measures a variety of different parameters such as the presence of noxious gases, moisture in the atmosphere or at ground level, and breakage in one or both rails of the track. The pilot vehicle is also equipped with a television camera which provides a visual image of the railroad track ahead of the pilot vehicle to the engineer of the train. An infrared camera which is mounted on the front of the pilot vehicle generates an infrared image of the tracks and is used during darkness or in severe weather conditions to monitor the tracks for unsafe conditions or to detect animals or humans from body radiation. Information gathered by the pilot vehicle's sensor array is supplied to a computer on board the pilot vehicle and is transmitted back to the train to enable the train's engineer to be apprised of conditions existing on the tracks ahead of the train in order to have time to react to potential hazards and dangerous situations on the railroad tracks.

16 Claims, 3 Drawing Sheets

PILOT VEHICLE WHICH IS USEFUL FOR MONITORING HAZARDOUS CONDITIONS ON RAILROAD TRACKS

BACKGROUND OF THE INVENTION

1. Field of the Invention

The present invention relates generally to the field of systems for monitoring hazardous conditions on railroad tracks. More specifically, the present invention relates to surveillance systems on board a pilot vehicle travelling ahead of a train which senses conditions including hazards existing on the tracks and then communicates with the train about these conditions.

2. Description of the Prior Art

As technology has developed, mankind has vastly increased his mobility. At one time, a horse-drawn chariot was the fastest mode of surface transportation available. Today, one can travel across the country by train at speeds in excess of 100 miles per hour.

Unfortunately, as speeds of trains increase, the potential danger from operating and riding on trains has also increased. The time which the operator of the train has to react to a potentially dangerous situation (such as an obstruction in the path of the train) decreases proportionally with the speed of the train. For this reason, the risk of a serious accident to personnel on board the train and the occurrence of these accidents increases dramatically. In addition, nearly any accident involving a train travelling at very high speeds (between 60 and 100 miles per hour) is likely to be a serious accident involving injury and even death to personnel on board the train.

Many potentially dangerous situations arise for trains travelling at high speeds on today's railroads. For example, railroad tracks, roadbed and bridges and other structures in the path of a train can be damaged by natural occurrences such as floods or landslides or man made occurrences such as sabotage of the track on which the train is travelling.

Stopped vehicles, such as a car, bus or truck stalled at a railway crossing or another train on the same track, can obstruct the track ahead of a rapidly moving train and are a serious and frequent problem for today's high speed trains. By the time the engineer of the rapidly moving train discovers the vehicle, there is generally an insufficient distance between the train and the vehicle for the engineer to safely bring the train to a complete stop and avoid the stalled vehicle. A collision between the rapidly moving train and the stalled vehicle will almost always result in a loss of life and substantial property damage.

Solutions to this problem have been proposed in the past. For example, U.S. Pat. No. 4,578,665 to Yang (issued Mar. 25, 1986) discloses a self-propelled remotely controlled satellite car which proceeds a train along train tracks. The satellite car is remotely controlled to travel a predetermined distance ahead of the train. The satellite car is equipped with a sensor array which measures a variety of different parameters such as sound level, temperature, the presence of noxious gases, moisture, orientation with respect to the direction of the force of gravity and vibration level. Information gathered by the satellite car is transmitted back to the train to enable the train engineer to be apprised of conditions existing on the tracks ahead of the train in order to have time to react to potential hazards. Position indicators disposed along the tracks transmit position information to the satellite car to permit the satellite car to correlate measured information with expected information. The satellite car and the train are linked by transmitters and receivers.

U.S. Pat. No. 3,128,975 to Dan (issued May 17, 1960) discloses a surveying system in which a detector assembly precedes a train on the same track at a remotely controlled distance ahead of the train. The detector assembly comprises a drive car and a driven car. The driven car is coupled to the drive car through a coupling arm which functions to hold a switch open. When the driven car encounters an obstacle the coupling is released initiating the sending of a danger signal and to stop the drive car.

While these pilot vehicles are satisfactory for their intended purpose of providing an indication to an engineer on a moving train of potentially dangerous situations or obstructions in path of the train, there is still a need to integrate today's state of the art technology into a pilot vehicle which is highly efficient, very reliable and relatively inexpensive to maintain and operate.

SUMMARY OF THE INVENTION

The present invention overcomes some of the disadvantages of the prior art including those mentioned above in that it comprises a highly efficient and very reliable pilot vehicle which precedes a train. The pilot vehicle of the present invention is a remotely controlled railroad vehicle for reducing the frequency of railway accidents. The pilot vehicle and the train to be protected travel rectilinearly along the same railway tracks. The pilot vehicle includes a propulsion device for propelling the pilot vehicle along the tracks. The propulsion device is controlled by an on board computer which maintains the satellite car at distance D ahead of the train which will allow the train to come to a safe stop in the event the pilot vehicle encounters a safety hazard or obstacle on the tracks.

The pilot vehicle's on board computer may also be remotely controlled by signals transmitted by a transmitter on board the train. Multiple sensing devices on board the pilot vehicle acquire information about the conditions existing on the tracks in proximity to the pilot vehicle and then transmit this information back to the train. The train receives and displays the transmitted information which is used by the train's engineer to determine if hazards or dangerous conditions exist on the tracks in front of the train.

The pilot vehicle's sensing devices include a noxious gas detector for detecting the presence of at least one of a plurality of gases in proximity to the pilot vehicle. The sensing devices also include a moisture detector disposed on the pilot vehicle a predetermined distance above the rails for detecting the presence of water. The sensing devices may include a television camera for monitoring the visual scene presented to the pilot vehicle as the pilot vehicle travels along the rails. The sensing devices may include an infrared camera for providing an infrared image of the scene ahead of the pilot vehicle as the pilot vehicle travels along the rails. The sensing devices may also include a variety of magnetic signature sensing systems which are positioned in close proximity with the rails of the track to sense and compare with pre-recorded data the strength of a magnetic field generated by low level currents induced in the rails of the track.

The sensing devices may include a magnetic rail analysis system which detects and records an induced response for each section of rail of the railroad tracks in response to a low strength alternating current magnetic field generated by the magnetic rail analysis system. The magnetic response detected by the magnetic rail analysis system is compared by the pilot vehicle's computer with a stored library of magnetic responses for each section of track on the route the pilot vehicle and the train are to traverse. Differences between the present magnetic response and the recorded magnetic response indicate a change in the structure of the section of track being sampled and thus possible damage to the track.

DETAILED DESCRIPTION OF THE DRAWINGS

DETAILED DESCRIPTION OF THE PREFERRED EMBODIMENT

Figure 1:
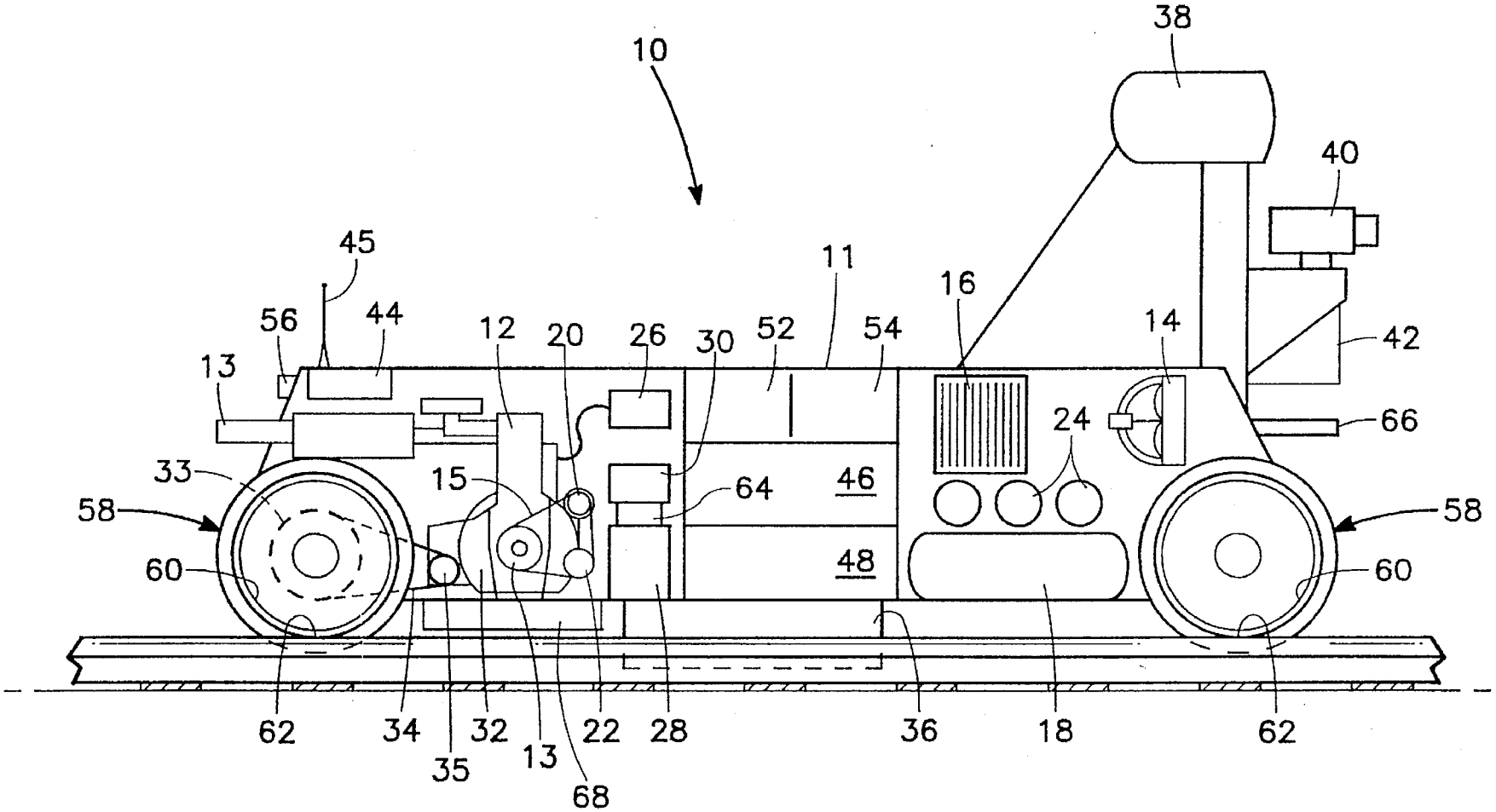
FIG. 1 is a detailed side view of a pilot vehicle of the present invention which is useful for monitoring hazardous conditions on a railroad track ahead of a train travelling at high speeds.
Figure 2:
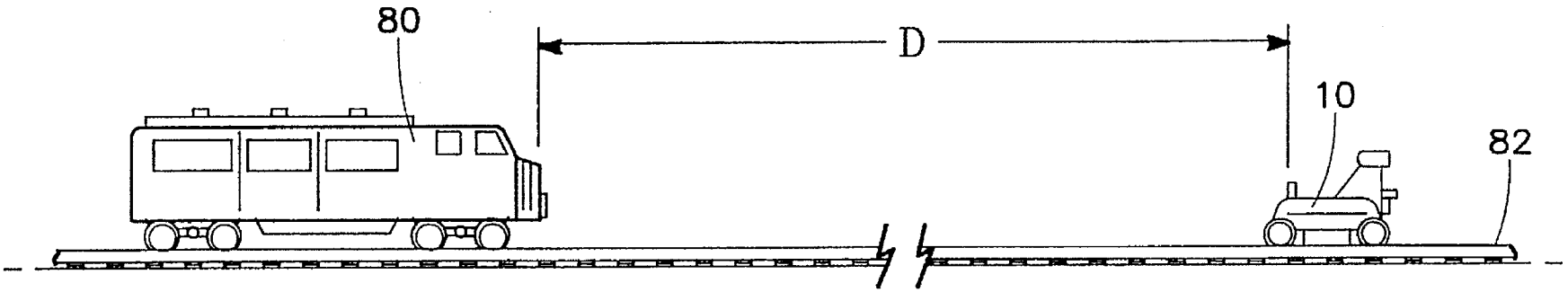
FIG. 2 is a side view of a rapidly moving train following the pilot vehicle of FIG. 1 at a predetermined safe distance D.

Referring first to FIGS. 1 and 2, there is shown a pilot vehicle (designated generally by the reference numeral 10) which proceeds a rapidly moving train 80 along a set of rails or railroad track 82. Pilot vehicle 10 is self propelled and is remotely controlled by transmissions produced by train 80. If pilot vehicle 10 encounters a potential hazard in railroad track 82 such as a stalled car, truck or bus at a railroad crossing, vehicle 10 may transmit information about the hazard back to train 80. This permits the engineer driving train 80 to stop train 80 well before train 80 encounters the hazard.

In accordance with the present invention, pilot vehicle 10 is remotely controlled from train 80. Mounted on board pilot vehicle 10 are sensing systems (to be discussed in greater detail shortly) for detecting and surveying conditions on railroad track 82 (such as a stalled vehicle at a crossing) as well as the condition of the track (as in a washed out bridge or a breakage in the rail of the track).

Pilot vehicle 10 includes an independent propulsion system that may be computer operated from pilot vehicle 10 or may be remotely controlled via a control signal transmitted from train 80 and received by pilot vehicle 10. The self-propelled propulsion system for pilot vehicle 10 comprises a diesel engine 12 mounted on a lower portion of the frame 11 of pilot vehicle 10 in proximity with the rear wheels of pilot vehicle 10. Diesel engine 12 includes a torque converter transmission 32 which has a drive pulley 35. There is attached to the left rear axle for left rear wheel 58 of pilot vehicle 10 a driven pulley 33. Connecting drive pulley 35 to driven pulley 33 is a drive belt 34. When transmission 32 rotates drive pulley 35 in a clockwise direction, drive pulley 35 drives driven pulley 33 in the clockwise direction causing pilot vehicle 10 to move in a forward direction (from left to right in FIG. 2). In a like manner, when transmission 32 rotates drive pulley 35 in a counter-clockwise direction, drive pulley 35 drives driven pulley 33 in the counter-clockwise direction causing pilot vehicle 10 to move in a rearward direction (from right to left in FIG. 2). It should be noted that the rear wheel drive system of pilot vehicle 10 may be a conventional differential drive system which permits the rear wheels to be driven at different speeds when pilot vehicle 10 is at a bend in railroad tracks 82.

Attached to diesel engine 12 is an exhaust 13 which expels exhaust fumes from diesel engine 12 into the atmosphere. Mounted on frame 11 near the front wheels 58 of pilot vehicle 10 is a fuel tank 18 which is used to store diesel fuel for the diesel engine 12 of pilot vehicle 10. Fuel tank 18 is connected to diesel engine 12 by a fuel pipe (not illustrated) and a fuel pump (not illustrated) which is used to pump diesel fuel from tank 18 to diesel engine 12. Pilot vehicle 10 also has a cooling system which includes a radiator and an exhaust fan 14 for cooling engine 12. The exhaust fan of radiator 14 moves cool air from the atmosphere across radiator 14 cooling radiator 14. The air for cooling radiator 14 is expelled into the atmosphere through a plurality of air vents 16 located in each side of the frame 11 of pilot vehicle 10.

The electrical power system for pilot vehicle 10 comprises a battery 28 and an alternator 20. Diesel engine 12 has a drive pulley 13 which is coupled to alternator 20 by a drive belt 15. Drive belt 15 also connects diesel engine 12 to an air compressor 22.

Air compressor 22 is connected to three air storage tanks 24 which store compressed air for use by an air activated braking system (not illustrated). The braking system for pilot vehicle 10 also includes a braking electronics module 30 which is coupled to computer 46 and a brake servo 64 coupled to braking electronics module 30. When computer 46 supplies digital braking control signals to braking electronics module 30, brake servo 64 activates the braking system for pilot vehicle 10 either bringing pilot vehicle 10 to a complete stop or significantly reducing the speed of pilot vehicle 10.

Pilot vehicle 10 also has a fluid or hydraulically activated rail clamp brake system 36 attached to the bottom of frame 11 of pilot vehicle 10. Rail clamp brake system 36 is used primarily in emergency situations (such as an obstacle in the path of train 80) when it is required to bring pilot vehicle 10 to a complete stop in a short distance. Rail clamp brake system 10 is connected to air storage tanks 24 to receive compressed air from tanks 24. Rail clamp brake system 36 is also connected to computer 46 and receives digital rail clamp braking control signals from computer 46. The digital rail clamp braking control signals provided by computer 46 activate rail clamp brake system 36 which has a pair of engaging members (not shown) with the engaging members of rail clamp brake system 36 engaging both rails of railroad track 82 to bring pilot vehicle 10 to an emergency stop.

The Diesel engine's RPM (revolutions per minute) and thus the speed of pilot vehicle 10 are regulated by a throttle control 26 which is connected to the throttle of diesel engine 12. Throttle control 26 is also connected to on board computer 46 which provides digital throttle control signals to throttle control 26 to control the engine's RPM and the speed of pilot vehicle 10.

Figure 3:
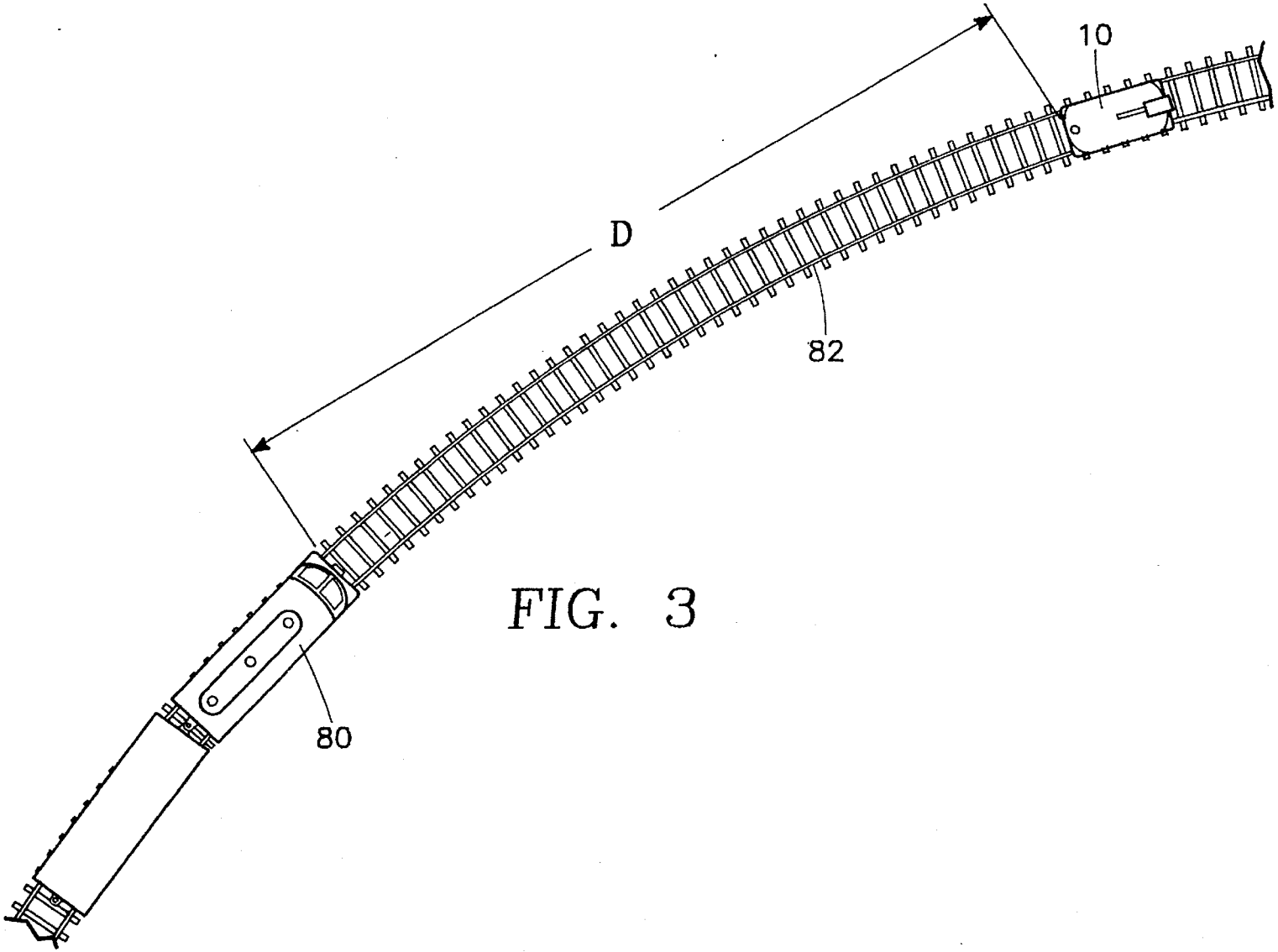
FIG. 3 is a top view of a rapidly moving train following the pilot vehicle of FIG. 1 at the predetermined safe distance D.

Computer 46 includes a distance keeping control module 54. Module 54 receives digital information and control signals from train 80 relating to its speed and present location relative to pilot vehicle 10. Module 54 uses this digital information to calculate a safe stopping distance D (illustrated in FIGS. 2 and 3) for train 80. The distance D is the minimum safe stopping distance required by train 80 to come to a complete stop without causing damage to the train and injury to the personnel on board train as well as injury and damage to any obstacle in the path of train 80 such as a stalled vehicle at a railroad crossing. Factors utilized in calculating the minimum safe stopping distance D for train 80 include the present speed of train 80, the grade of the track 82 upon which train 80 is presently travelling, the number of cars comprising train 80 and their weight, and the present weather conditions. When module 54 of computer 46 finishes its calculation for the present minimum safe stopping distance D for train 80, computer 46 supplies throttle control signals to throttle control 26 adjusting the throttle of engine 12 which causes pilot vehicle 10 to accelerate, decelerate or maintain its present speed to keep the distance D relatively constant. The distance D also has an upper limit (one to two miles, for example) which is commensurate with railway control systems (such as block systems which monitor the movement, speed and spacing of multiple trains) so that pilot vehicle 10 is considered a part of train 80. When the upper limit for distance D is exceeded then computer 46 will cause pilot vehicle 10 to decelerate until the distance between pilot vehicle 10 and train 80 is less than this upper limit. The train 80 may, for example, provide a control signal to the pilot vehicle 10 indicating to the pilot vehicle 10 that the train has stopped. The pilot vehicle 10 will also stop at the distance D ahead of the train.

Pilot vehicle 10 has a video camera 40 mounted on its front end. Video camera 40 allows the engineer in train 80 to observe the tracks 82 in front of pilot vehicle 10 via a video monitor (not shown) in the cab of train 80. By monitoring a visual image of a section of track 82 well ahead of train 80, the engineer on board train 80 can know what to expect and may take appropriate action to prevent potentially dangerous situations from occurring.

When, for example, pilot vehicle 10 is traveling at a speed of about 100 miles per hour and the engineer of train 80 while monitoring the video monitor in the cab of train 80 observes a bus or truck stalled at a railroad crossing, the engineer of train 80 can transmit an emergency stop signal to pilot vehicle 10. This emergency stop signal will activate the engaging members of rail clamp braking system 36 bringing pilot vehicle 10 to a complete stop in about eleven feet. Since pilot vehicle 10 weighs around five hundred pounds, a pilot vehicle 10 travelling at a speed of 100 miles per hour would subject the track 82 to a force of about 15,000 pounds during the emergency stop thus preventing serious damage to the rails of railroad track 82. In addition, the short stopping distance required to bring pilot vehicle 10 to an emergency stop would prevent serious damage to pilot vehicle 10, the vehicle stalled at the railroad crossing and also would prevent serious injury to the occupants of the vehicle.

It should be noted that video camera 40 may comprise a conventional fast scan or slow scan video camera which produces video information. Video camera 40 may include conventional servo motors to enable the engineer of train 80 to change the direction in which video camera 40 is aimed or the magnification of the camera lens of video camera 40.

There is also mounted on the front end of the frame 11 of pilot vehicle 10 an infrared camera 42 which allows the engineer of train 80 to monitor the tracks 82 ahead of pilot vehicle 10 in severe weather conditions or in total darkness. The infrared camera 42 is also adapted to detect humans or animals on or near tracks 82 by sensing their body temperature infrared signals.

The video signal from video camera 40 is supplied to a sensor data processing module 48 within computer 46 for processing thereby. The video signal is transmitted to train 80 utilizing a modulated radio frequency (RF) signal which the video monitor demodulates to provide a visual image/scene of the railroad track 82 in front pilot vehicle 10 for the engineer of train 80. The infrared image/scene is transmitted from pilot vehicle 10 to train 80 in a similar manner allowing the engineer of train 80 to observe an infrared image of the railroad track 82 in front of pilot vehicle 10 in severe weather conditions or in total darkness or to detect animals or humans.

There is also mounted on the front of the frame 11 of pilot vehicle 10 an air sampling tube 66 which samples the atmosphere surrounding pilot vehicle 10. Air sampling tube 66 comprises a plurality of different conventional gas sensors each of which is sensing for the presence of a different hazardous or noxious gas above a predetermined safety level in the path of pilot vehicle 10. The gases which the gas sensors of air sampling tube 66 sense include carbon monoxide, methane, etc. which pilot vehicle 10 and train 80 may encounter while travelling through a tunnel or a wooded area where a fire is burning. The sensors of air sampling tube 66 are connected to the sensor data processing module 48 within computer 46 and provide electrical warning signals to module 48 for processing by module 48 whenever a noxious gas such as carbon monoxide exceeds the predetermined safety level for the particular noxious gas. Computer 46 generates a noxious gas warning message identifying the noxious gas which is transmitted via a radio frequency signal or the like to the engineer of train 80 indicating to the engineer of train 80 that a noxious gas is present in the atmosphere around pilot vehicle 10. The noxious gas warning signal also identifies the noxious gas for the engineer of train 80.

Air sampling tube 66 may also include a moisture detector which comprises an electrode located within air sampling tube 66. The moisture detector within air sampling tube 66 monitors the moisture level in the atmosphere surrounding pilot vehicle 10 to indicate to train 80 whether pilot vehicle 10 is traveling through severe rainstorms or possibly a high water level which would be dangerous to train 80. The moisture detector within sampling tube 66 also provides a warning signal to sensor data processing module 48 of computer 46 whenever the moisture level within the atmosphere exceeds a predetermined safety level. The moisture detector within sampling tube 66 may operate using the difference in electrical conductivity between air and water, or it may comprise any other conventional moisture detector.

Each of the four wheels 58 of pilot vehicle 10 is electrically conductive at its outer flange 62 which is in contact with the rail of railroad track 82. Outer flange 62 is electrically insulated from the remainder of the wheel and pilot vehicle 10 by an insulated ring 60 located adjacent the outer flange 62 of each wheel 58. These electrically insulated wheels allow pilot vehicle 10 to activate railroad block signal control systems, crossing gates and the like.

In addition, the electrically conductive outer flange 62 of each wheel 58 of pilot vehicle 10 include slip rings (not shown) which allow the electrically conductive outer flange 62 of each wheel 58 to be connected to the sensor data processing module 48 of computer 46. The wheels 58 of pilot vehicle 10 sense breaks in the rail of railroad track 82 which effect the intensity level of currents passing through the rails of track 82 from the front wheels 58 to the rear wheels 58 of pilot vehicle 10. The current from the rails also passes through the wheels 58 to the sensor data processing module 48 of computer 46. When a partial or complete break in either rail of track 82 occurs the intensity of the current flow through the wheels 58 of pilot vehicle 10 will change. The sensor data processing module 48 of computer 46 senses this change in current flow providing a digital signal to computer 46 which then generates a warning message indicating track breakage which is transmitted to the engineer of train 80.

The communications system for pilot vehicle 10 includes a transmitter/receiver 44 which is placed on board pilot vehicle 10. The transmitter and the receiver of transmitter/receiver 44 are connected via a transmit/receive switch (not shown) to an antenna 45 mounted on pilot vehicle 10 near the rear end of pilot vehicle 10. The transmitter and the receiver of transmitter/receiver 44 are tuned to the same frequency as the transmitter and the receiver on board train 80. In this way, control information generated on board train 80 may be transmitted via the transmitter of train 80 to the receiver of transmitter/receiver 44 and thereafter supplied to circuitry including computer 46 on board pilot vehicle 10. Likewise, information sensed by pilot vehicle 10 may be transmitted to train 80 via the transmitter of transmitter/receiver 44 to the receiver on board train 80 and thereafter supplied to the monitoring systems on board train 80 to apprise the engineer of rail conditions ahead of train 80.

The transmitter 44 of transmitter/receiver 44 transmits microwave signals to the receiver on board train 80. The microwave signals may be radio frequency signals or other signals in the microwave signal frequency range. The microwave signals are generally transmitted through the air via antenna 45. The microwave signals transmitted by the transmitter of transmitter/receiver 44 may be modulated by a signal modulator 52 which is responsive to the signals produced by various sensors on board pilot vehicle 10. Signal modulator 52 may modulate these microwave signals by any known modulation method (such as frequency modulation, amplitude modulation, pulse code modulation, pulse width modulation, etc.). The microwave signals generated by the transmitter of transmitter/receiver 44 may also be modulated by the video signal produced by television camera 40. The receiver of transmitter/receiver 44 is connected to a signal demodulator which is an electrical component of signal modulator 52 and which demodulates the signals impressed upon the microwave signals transmitted by train 80 to pilot vehicle 10.

It should be noted that VHF (very high frequency) signals and RF (radio frequency) signals could also be used to transmit information from pilot vehicle 10 to train 80 as well as transmitting information from train 80 to pilot vehicle 10. A system which may be adapted for use with pilot vehicle 10 is the AN/URY-3 relay/responder/reporter which is a multilateration tracking system for extended area tracking. Communications between relay/responder/reporter units is a radio frequency transmission of spread spectrum pulses centered at 141 MHz, utilizing antennas similar to antenna 45 of pilot vehicle 10.

As is well known, plural signals may be multiplexed onto the same transmitted carrier signal. The transmitter of transmitter/receiver 44 may produce microwaves, infrared radiation or ultrasonic radiation. A receiver on board train 80 receives the transmitted signal and demultiplexes the various signals impressed upon it. Each of the demultiplexed signals may be routed to a respective indicator on board train 80.

Those skilled in the art can readily devise other methods for transmitting information between pilot vehicle 10 and train 80. For example, conventional electrical signals conducted by the rails or by overhanging cables could be used to convey information. Acoustic signals transmitted over the rails might be used to transmit information between train 80 and pilot vehicle 10. The present invention is by no means limited to any one such method for transmitting information between train 80 and pilot vehicle 10.

Mounted on frame 11 at the rear of pilot vehicle is a rear warning light 56 which indicates to train 80 or another railroad vehicle approaching pilot vehicle 10 from its rear that pilot vehicle 10 is within sight of the oncoming vehicle. There is also attached to the front of frame 11 a headlight 38 which warns objects in the path of pilot vehicle 10 that pilot vehicle 10 is approaching. In addition, pilot vehicle 10 may be equipped with a horn, whistle or the like which functions as a warning device when pilot vehicle 10 is approaching a station, a railroad crossing, a train temporarily stopped at a siding or other objects which may be in the path of pilot vehicle 10.

Pilot vehicle 10 has a magnetic signature sensing system 68 which is mounted on the underside of the frame 11 of pilot vehicle 10 so as to be in close proximity with each rail of railroad track 82. Magnetic signature sensing system 68 senses the strength/intensity of the magnetic field generated by low level currents passing through the rails of track 82. When there is break in one or both of the rails of railroad track 82, current will cease flowing through the broken rails. Magnetic signature sensing system 68 will then detect the resulting decrease in the strength of the magnetic field Should only one rail break or the lack of a magnetic field should both rails break. Magnetic signature sensing system 68 is connected to the sensor data processing module 48 of computer 46 to receive an electrical signal from magnetic signature sensing system 68 which indicates the strength of the magnetic field surrounding the rails of railroad track 82. When sensor data processing module 48 of computer 46 detects a significant decrease in the voltage level of the electrical signal from system 68 indicating a significant decrease in the magnetic field strength, computer 46 generates a warning message which is transmitted via a radio frequency signal or the like to the engineer of train 80 indicating a break in one or both rails of the track ahead of train 80. If, for example, the voltage level of the electrical signal from system 68 is zero volts this indicates that both rails of railroad track 82 are broken.

Magnetic signature sensing system 68 may comprise an AC (alternating current) magnetic bridge coil which generates a low energy alternating magnetic field that couples with an adjacent section of rail of track 82. An alternating current bridge operating at a pre-selected frequency may be chosen for measurement sensitivity. An inductive reactance measured by the sensor coil of the bridge will unbalance the bridge circuit to a magnitude which is unique to an adjacent section of the rail. This unbalanced signal is compared with a prior recorded unbalanced signature for the section of rail being sampled which is stored in computer 46. The location of the section of track being measured may be determined by the number of revolutions of wheels 58. Computer 46 uses the count of the number of revolutions of wheels 58 for a comparison with position information stored in computer 46 to determine the precise location of the section of track being sampled by magnetic signature sensing system 68.

A wave guide mounted on pilot vehicle 10 may be used to perform a structural analysis of the rail of track 82 to determine if there is damage to the rail of track 82. The standing wave ratio of the waveguide (which may be an x-band waveguide) is compared with a prior standing wave ratio (stored in computer 46) for the particular section of track being measured. Significant differences in the standing wave ratios indicate a structural change in the rails of track 82 and thus possible damage to the rails of track 82.

From the foregoing, it may readily be seen that the present invention comprises a new, unique and exceedingly useful pilot vehicle which is useful for monitoring hazardous conditions on railroad tracks and which constitutes a considerable improvement over the known prior art. Obviously many modifications and variations of the present invention are possible in light of the above teachings. It is therefore to be understood that within the scope of the appended claims the invention may be practiced otherwise than as specifically described.

What is claimed is:

1. A system for surveying railway tracks ahead of a train, said train being adapted to travel along said railway tracks, said system comprising:

a pilot vehicle traveling along said railway tracks ahead of said train, said pilot vehicle including:

drive means for propelling said pilot vehicle along said railway tracks;

processing means for receiving position information and control signals transmitted by said train, said processing means processing said position information and control signals to determine a safe distance said pilot vehicle is to be disposed away from said train;

drive control means operatively connected to said processing means and said drive means for maintaining said pilot vehicle at said safe distance from said train;

television camera means mounted on said pilot vehicle at a front end of said pilot vehicle, said television camera means monitoring a visual scene presented to said pilot vehicle as said pilot vehicle travels along said railway tracks, said television camera means generating a video signal representative of said visual scene presented to said pilot vehicle as said pilot vehicle travels along said railway tracks;

transmitter/receiver means connected to said television camera means to receive said video signal from said television camera means, said transmitter/receiver means including modulating means for modulating a first radio frequency signal responsive to said video signal and an antenna for transmitting said first radio frequency signal to said train;

magnetic signature sensing means mounted on an underside of said pilot vehicle in proximity with a pair of rails of said railroad track, said magnetic signature sensing means measuring a magnetic field generated by a current flowing through at least one of said pair of rails of said railroad track, said magnetic signature sensing means generating a first electrical signal proportional to an intensity of said magnetic field;

said processing means receiving said first electrical signal from said magnetic signature sensing means, said processing means generating a warning message whenever a voltage level of said first electrical signal decreases below a predetermined voltage level;

said modulating means modulating a second radio frequency signal responsive to said warning message;

said antenna transmitting said second radio frequency signal to said train;

an infrared camera mounted on the front end of said pilot vehicle, said infrared camera monitoring an infrared scene presented to said pilot vehicle as said pilot vehicle travels along said railway tracks, said infrared camera generating a second electrical signal representative of said infrared scene presented to said pilot vehicle as said pilot vehicle travels along said railway tracks;

said transmitter/receiver means being connected to said infrared camera to receive said second electrical signal from said infrared camera;

said modulating means modulating a third radio frequency signal responsive to said second electrical signal; and said antenna transmitting said third radio frequency signal to said train.

2. The system of claim 1 wherein said processing means comprises a computer.

3. The system of claim 1 wherein said television camera means comprises a video camera.

4. The system of claim 1 further comprising gas detecting means mounted at the front end of said pilot vehicle for detecting the presence of a plurality of gases in proximity with said pilot vehicle, said gas detecting means generating a third electrical signal whenever said gas detecting means detects the presence of at least one of said plurality of gases in proximity with said pilot vehicle.

5. The system of claim 4 wherein said gas detecting means includes a moisture detector for monitoring moisture in the atmosphere surrounding said pilot vehicle to determine whether said pilot vehicle is traveling through rainstorms or a water level which is dangerous to said train.

6. The system of claim 1 further comprising a headlight attached to the front end of said pilot vehicle.

7. The system of claim 1 further comprising a rear warning light mounted on said pilot vehicle at a rear end of said pilot vehicle.

8. The system of claim 1 wherein the warning message generated by said processing means is transmitted to said train to indicate to an engineer of said train that at least one of said pair of rails of said railway tracks is damaged.

9. A system for surveying railway tracks ahead of a train, said train being adapted to travel along said railway tracks, said system comprising:

a pilot vehicle traveling along said railway tracks ahead of said train, said pilot vehicle including:

drive means for propelling said pilot vehicle along said railway tracks;

a computer for receiving position information and control signals transmitted by said train, said computer processing said position information and control signals to determine a safe distance said pilot vehicle is to be disposed away from said train;

drive control means operatively connected to said computer and said drive means for maintaining said pilot vehicle at said safe distance from said train;

a video camera mounted on said pilot vehicle at a front end of said pilot vehicle, said video camera monitoring a visual scene presented to said pilot vehicle as said pilot vehicle travels along said railway tracks, said video camera generating a video signal representative of said visual scene presented to said pilot vehicle as said pilot vehicle travels along said railway tracks;

a transmitter/receiver module connected to said video camera to receive said video signal from said video camera, said transmitter/receiver module including a modulator for modulating a first radio frequency signal responsive to said video signal and an antenna for transmitting said first radio frequency signal to said train;

a magnetic signature sensing system mounted on an underside of said pilot vehicle in proximity with a pair of rails of said railroad track, said magnetic signature sensing system measuring a magnetic field generated by a current flowing through at least one of said pair of rails of said railroad track, said magnetic signature sensing system generating a first electrical signal proportional to an intensity of said magnetic field;

said computer receiving said first electrical signal from said magnetic signature sensing system, said computer generating a first warning message whenever a voltage level of said first electrical signal decreases below a predetermined voltage level;

said modulator modulating a second radio frequency signal responsive to said first warning message; said antenna transmitting said second radio frequency signal to said train;

an infrared camera mounted on the front end of said pilot vehicle, said infrared camera monitoring an infrared scene in darkness and under adverse weather conditions presented to said pilot vehicle as said pilot vehicle travels along said railway tracks, said infrared camera generating a second electrical signal representative of said infrared scene presented to said pilot vehicle as said pilot vehicle travels along said railway tracks;

said transmitter/receiver module being connected to said infrared camera to receive said second electrical signal from said infrared camera;

said modulator modulating a third radio frequency signal responsive to said second electrical signal;

said antenna transmitting said third radio frequency signal to said train;

an air sampling tube mounted on the front end of said pilot vehicle for sampling the atmosphere surrounding said pilot vehicle, said air sampling tube including a plurality of gas sensors, each of said gas sensors being adapted to sense for a presence of one of a plurality of noxious gas, said air sampling tube generating a third electrical signal whenever at least one of said gas sensors detects the presence of at least one of said plurality of noxious gases;

said computer receiving said third electrical signal from said air sampling tube, said computer generating a second warning message;

said modulator modulating a fourth radio frequency signal responsive to said second warning message; and said antenna transmitting said fourth radio frequency signal to said train.

10. The system of claim 9 wherein said air sampling tube includes a moisture detector for monitoring moisture in the atmosphere surrounding said pilot vehicle to determine whether said pilot vehicle is traveling through rainstorms or a water level which is dangerous to said train.

11. The system of claim 9 further comprising a headlight attached to the front end of said pilot vehicle.

12. The system of claim 9 further comprising a rear warning light mounted on said pilot vehicle at a rear end of said pilot vehicle.

13. The system of claim 9 wherein the first warning message generated by said computer is transmitted to said train to indicate to an engineer of said train that at least one of said pair of rails of said railway tracks is damaged.

14. The system of claim 9 wherein the second warning message generated by said computer is transmitted to said train to indicate to an engineer of said train that said at least one of said noxious gases is present in the atmosphere surrounding said pilot vehicle.

15. The system of claim 9 wherein said magnetic signature sensing system comprises an alternating current magnetic bridge coil for generating said magnetic field in one of said pair of rails of said railroad track and an alternating current bridge operating at a pre-selected frequency for measuring the intensity of said magnetic field from the one of said pair of rails of said railroad track.

16. The system of claim 9 wherein said infrared camera is adapted to detect body temperature infrared signals from humans and animals on and near the pair of rails of said railroad track.

* * * * *